US011166550B1

(12) United States Patent
Plourde et al.

(10) Patent No.: US 11,166,550 B1
(45) Date of Patent: Nov. 9, 2021

(54) PRESSURE FIT MOUNTING KIT

(71) Applicants: David Plourde, Edmonton (CA); Jerome Armand Frechette, St. Albert (CA)

(72) Inventors: David Plourde, Edmonton (CA); Jerome Armand Frechette, St. Albert (CA)

( * ) Notice: Subject to any disclaimer, the term of this patent is extended or adjusted under 35 U.S.C. 154(b) by 0 days.

(21) Appl. No.: 16/859,381

(22) Filed: Apr. 27, 2020

(51) Int. Cl.
*A47B 88/43* (2017.01)
*A47B 57/06* (2006.01)

(52) U.S. Cl.
CPC ..... *A47B 88/43* (2017.01); *A47B 57/06* (2013.01); *A47B 2210/01* (2013.01); *A47B 2210/09* (2013.01)

(58) Field of Classification Search
CPC ..... A47B 88/43; A47B 88/044; A47B 47/00; A47B 55/00; A47B 57/06; A47B 57/18; A47B 57/44; A47B 2210/01; A47B 2210/09; F25D 25/02; F25D 2325/021
See application file for complete search history.

(56) References Cited

U.S. PATENT DOCUMENTS 2,114,390 A 4/1938 Lancaster
2,178,815 A * 11/1939 Shuart ..... F25D 25/02 312/306
3,337,283 A * 8/1967 Schlenkert ..... F25D 25/02 312/306
4,138,175 A * 2/1979 Tattershall ..... F25D 23/069 211/187
4,244,546 A * 1/1981 Mertes ..... A47B 88/407 248/258
4,378,173 A * 3/1983 Hopwell ..... F16B 7/10 248/188.5
5,356,206 A * 10/1994 Van Valkenburgh .. A47B 57/06 248/243
6,373,707 B1 4/2002 Hutchins
6,619,772 B2 * 9/2003 Dierbeck ..... B25H 3/028 312/334.1
6,976,745 B2 12/2005 Dobler et al.
9,028,017 B2 5/2015 Nicholson
2005/0264146 A1 12/2005 Fitz
2015/0076983 A1 * 3/2015 Lindblom ..... A47B 88/402 312/333
2018/0281699 A1 10/2018 Furniss

FOREIGN PATENT DOCUMENTS

CA 2082902 A1 5/1994
DE 2538844 A1 1/1976
DE 9302597 U1 * 10/1993 ..... A47B 57/06
DE 9401783 U1 * 5/1994 ..... A47B 87/005
DE 10235321 A1 * 2/2004 ..... A47B 57/06
(Continued)

*Primary Examiner* — Andrew M Roersma
(74) *Attorney, Agent, or Firm* — Stratford Group Ltd.

(57) ABSTRACT

A pressure mounting kit for a shelf or storage drawer that can be installed by pressure fit installation that does not requiring drilling or welding, that can be adjustable to any height and can accommodate one or more drawers. The kit can be adapted to be fitted within a recessed space such as an alcove, The kit is particularly useful in the trucking industry for a quick and easy means of installing drawers in cargo boxes to store rigging and the like at a reasonable cost.

11 Claims, 7 Drawing Sheets

(56) References Cited

FOREIGN PATENT DOCUMENTS

| | | | | | |
|---|---|---|---|---|---|
| DE | 102008045473 | A1 | * | 3/2010 | ..... A47B 88/49 |
| DE | 102009002796 | A1 | * | 11/2010 | ..... F25D 25/02 |
| FR | 444368 | A | * | 10/1912 | ..... A47B 57/06 |
| GB | 972158 | A | * | 10/1964 | ..... A47B 91/028 |
| JP | 10327957 | A | | 12/1998 | |

* cited by examiner

PRESSURE FIT MOUNTING KIT

BACKGROUND

Field of the Invention

The present disclosure relates to mounting kits, particularly to pressure fit mounting kits, more particularly to pressure fit mounting kits for shelves and storage drawers and methods for installing same in cavities or cargo boxes and the like.

Background

Numerous sliding track assembly mechanisms for household uses are known on pull out drawers and shelves. Typically, the sliding track assembly includes a slide assembly mounted to a rail assembly. Typically, the rail assembly is mounted in a case, rack, housing or other framed assembly and the slide assembly is attached to the drawer, shelf or other device. The slide assembly cooperates with the rail assembly and provides the extension mechanism for the drawer or shelf.

Typically each individual rail assembly is screwed into the vertical supporting members situated at the sided of each drawer. Similar, but strengthened and adapted, mechanisms are known for industrial applications. Typically, the mounting and installation of the slide and rail assemblies need to be more sturdy and the mounting often requires drilling or welding. In the trucking industry, the cargo spaces are of irregular sizes and often require custom installations. Custom built sliding track assembly mechanisms are expensive to fabricate and expensive, often requiring the truck to be off-the-road during installation.

There is a need for a sliding track assembly having a slide assembly and a rail assembly for use in confined or cavity spaces, such as the cargo hold of trucks. Advantageously, the assemblies can be assembled together quickly, easily and conveniently, without drilling or welding. Additionally, the mounting kit assemblies should be strong and secure when fitted and easy to disengage, if desired.

There are various different sliding track assembly mechanisms known in the field.

U.S. Pat. No. 9,028,017—describes a pressure mounted storage system with a locking friction clamp and a sliding container. In some implementations, an expandable or adjustable snap-in cam or other friction device having a mechanically lockable drawer, shelf or divider in a cabinet, pantry, kitchen cupboard mount includes no screws or other permanent mounting. The mountings, however, can only accommodate one draw or shelf per pair of mountings.

U.S. Pat. No. 6,976,745—describes a sliding track assembly having a slide assembly capable of quickly, easily and securely engaging a rail assembly and a method for assembling the slide and rail assemblies. The assembly of the slide assembly to the rail assembly requires no loose hardware or tools. This assembly is not pressure fit, it is not adjustable and it can only accommodate one draw.

CA2082902—describes a secure storage drawer and an installation clamp for the drawer. Suspension rails which support the slides for the drawer are so designed that when the drawer is closed there are no exposed fasteners The installation clamp permits a drawer to be retrofitted to installed furniture quickly and efficiently in situ. The installation clamp is useful for mounting any drawer supported by suspension brackets. This assembly requires drilling, it is not adjustable to any height and cannot accommodate more than one drawer.

U.S. Pat. No. 2,114,390-describes a means for assembling under pressure wherein brackets may be secured to one end of the frame. This assembly is also not pressure fit, it is not adjustable and it can only accommodate one draw.

DE2538844—describes a drawer with guide rail. From a tilted position the free arm of the rail is guided at right angles to the side wall where it fits behind the lip so that no special tools are necessary for the fastening. The assembly of the guide rail to the drawer side wall without the aid of a tool and without effort quickly and easily done. Again this assembly is not pressure fit, it is not adjustable and it can only accommodate one draw.

JPH10327957—describes a device to convert load component force of downward force by weight of load applied on a load bearing member in a shelf, a rod such as a tension rod, or a curtain rail or the like installed at a desired position in a place where two wall surfaces are facing each other or crossing with each other into a wall surface pressing force in which the wall surface pressing force is increased in proportion to applied load by use of a connection member installed in an inclined condition. Spring or screw, or suction cup, magnet, not only receive the load is held on the wall by the adhesive, the receiving member loads the load applied to the load receiving member, the load of the component force by the mechanism of the support member and the coupling member because converting the pressing force of the walls, in which the pressing force against the wall. No drilling or welding required for install. This assembly requires drilling, it is not adjustable to any height and cannot accommodate more than one drawer.

US20180281699—describes a storage drawer assembly capable of fitting to a vehicle. The drawer assembly comprises a primary space frame having at least a front wall, side walls and at least one intermediate wall between the sidewalls together defining compartments therein. The compartments are each capable of receiving and retaining there within a drawer mounted on a runner to enable the drawer to slide in and out of one said compartments. The installation of this device is not pressure fit, drilling or welding is required. It is not adjustable to any height and can accommodate only one drawer.

US20050264146—describes a mounting device for a cabinet, having an internal guide rail of a roller drawer slide for drawers disposed inside a cabinet body and spaced from the adjacent sidewall of the cabinet body on the rear wall of the cabinet body by a mounting fitting, which includes a mounting plate attachable to the rear wall of the cabinet and a rail support adjustably supported on the mounting plate. The installation of this device is not pressure fit, drilling or welding is required. It is not adjustable to any height and can accommodate only one drawer.

U.S. Pat. No. 4,244,546—describes a rear mounting bracket or mount for center guide type drawer guides is universally adjustable relative to the cabinet in which it is mounted. A base attaches one side of the mounting bracket to a mounting surface. A drawer guide attaching member connects the other side of the mounting bracket to a furniture-type drawer guide. An adjusting structure forms the interface between the base and guide attaching member and allows positional adjustment of the drawer guide. The installation of this device is not pressure fit, drilling or welding is required. It is not height adjustable and can accommodate only one drawer.

U.S. Pat. No. 6,373,707—describes slide assemblies of the type used for mounting drawers and shelving modules for sliding components into and out of rack assemblies, cabinets and other support structures or framework. The installation of this device is not pressure fit, drilling or welding is required. It is not adjustable to any height and can accommodate only one drawer.

None of the above cited documents, alone or in combination satisfy the need for a storage drawer mounting kit that can be installed by pressure fit installation that does not requiring drilling or welding, that can be adjustable to any height and can accommodate one or more drawer. In particular, there remains a need in the trucking industry for a quick and easy to install means of organizing cargo boxes at a reasonable cost. Currently, the only option is to spend large sums of money and have a custom built device. There therefore remains a need for a solution to the problem of how to install one or more adjustable drawer units in a cavity unit or space, typically but not exclusively in a truck.

All above cited documents are incorporated herein by reference.

BRIEF SUMMARY

It is an object of the invention to provide pressure fit mounting kit.

In accordance with an aspect of the invention there is provided a pressure fit mounting kit for one or more shelves or drawers, comprising: two or more pairs of extendible threaded rods; one or more pairs of support plates configured to cooperate with the rods, and means of fastening the support plates on the threaded rods, wherein, when the rods are extended to fit vertically within a cavity, the plates are secured horizontally in place on the rods by the securing means.

In accordance with another aspect of the invention there is provided a method of installing a mounting kit into a cavity space, said cavity having a roof, a floor and two side walls, said method comprising the steps: constructing a pair of side mounting mechanisms, each comprising one or more horizontal support plates, each support plate having a corresponding support plate located on opposing side mounting mechanism, each horizontal support plate being attached to two or more vertically extendible threaded rods; and fastening one of the pair of side mounted mechanisms adjacent to each of the side walls of the cavity, by extending the rods until a secure pressure fit is achieved between roof and floor of the cavity.

In accordance with yet another aspect of the invention there is provided A method of installing one or more drawers in a cavity space, said cavity having a roof, a floor and two side walls, said method comprising the steps: constructing a pair of side mounting mechanisms, each comprising one or more opposing horizontal support plates attached to two or more vertically extendible threaded rods; fastening one of the pair of side mounted mechanisms adjacent to each of the side walls of the cavity, by extending the rods until a secure pressure fit is achieved in between roof and floor of the cavity; attaching a runner mechanism to an inner surface of each of the opposing horizontal support plates; and installing a drawer, comprising a slider mechanism sized and positioned on outer side edges of the draw to cooperate with two of the opposing horizontal support plates, said drawer sized to fit within the cavity.

The advantages and features of the present invention will become better understood with reference to the following more detailed description and claims taken in conjunction with the accompanying drawings in which like elements are identified with like symbols and in which:

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Devices and methods for carrying out the invention are presented in terms of embodiments depicted within the FIGS. However, the invention is not limited to the described embodiments, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and the configurations shall be shown and described for purposes of clarity and disclosure and not by way of limitation of scope.

The present invention describes a mounting kit for shelves or drawers where no drilling or welding is required for installation. The kits can be easily installed and easily adjusted for customer preferences. The pressure fit mounting kit can accommodate more than one shelf or drawer.

The mounting kit is designed for installation in many different cavities including but not limited to cargo boxes. It disperses the weight of the drawers to the strongest point of the cavity or cargo box. The kit is a pressure fit install, no drilling or welding is required. This mounting kit also allows the shelves or drawers to be easily set to any height that the customer may want.

This mounting kit was designed for quick and easy install. It requires no drilling or welding and can accommodate multiple shelves and/or drawers to maximize square footage. There are no pricey appointments with fabrication shops. It is possible to maximize storage space in cavities and cargo boxes, and can be built for multiple shelves or drawers per box. The customer can keep their cost down by having the option of installing this kit in their existing boxes. Moreover, the mounting kits are built with quality materials to ensure long durability.

The terminology used in this application is meant to include all types of runners, rails, extendible rods and compression pads and alternate technologies which provide the same functionality as described herein.

Figure 1:
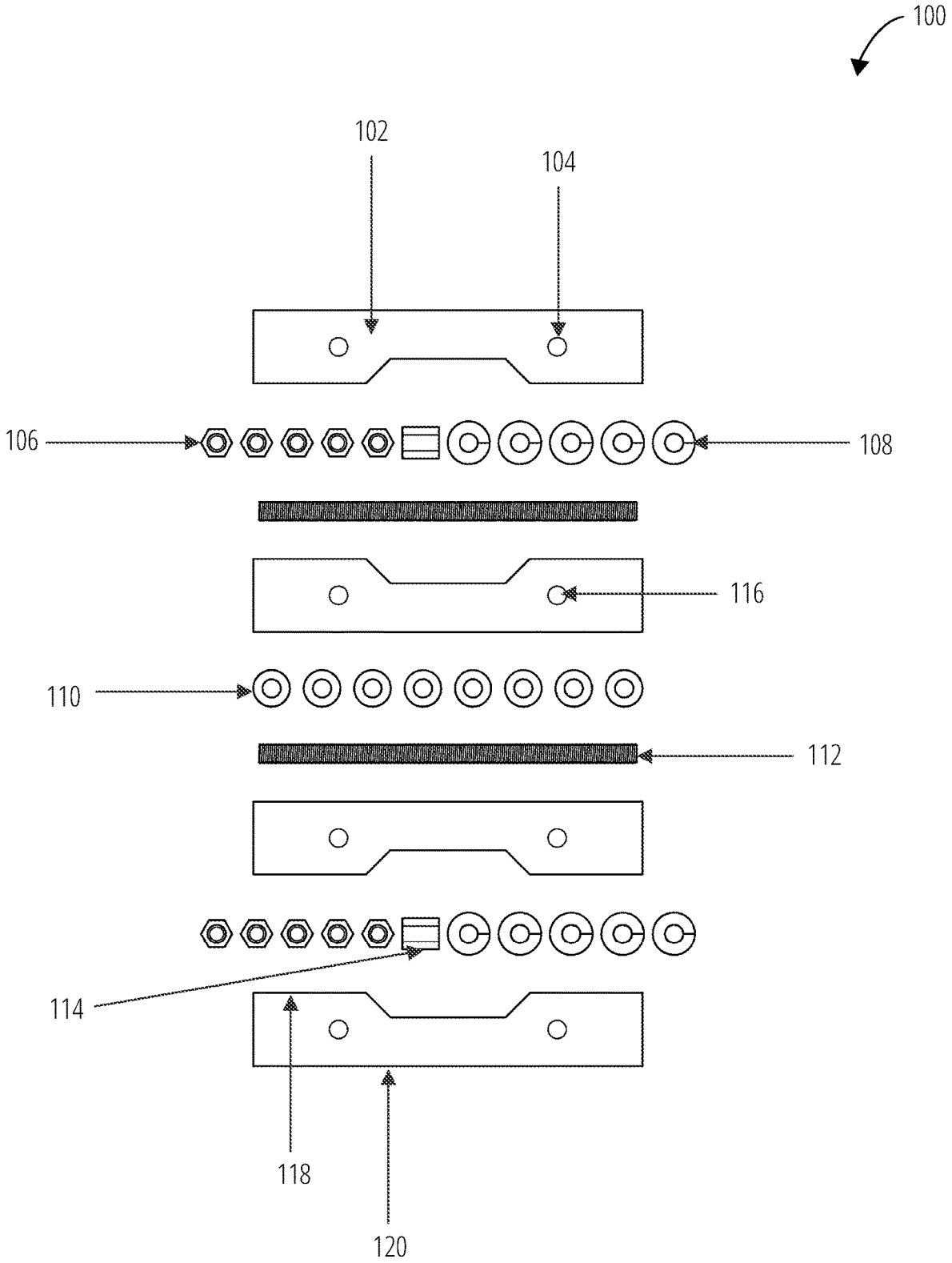
FIG. 1 illustrates an exploded view of kit 100 in accordance with one embodiment of the invention.

FIG. 1 illustrates an exploded collection of various parts that may constitute a typical mounting kit in accordance with an embodiment of the invention.

The kit may comprise: several support plates 102, some of which contain holes 116 and some of which contain countersunk holes 104. Each of the support plates 102 have a side wall facing side 118 and a drawer facing side 120. The kits may contain threaded rods 112 and a number of nuts 106, washers 110, split rings 108, and spacers 114.

Figure 2:
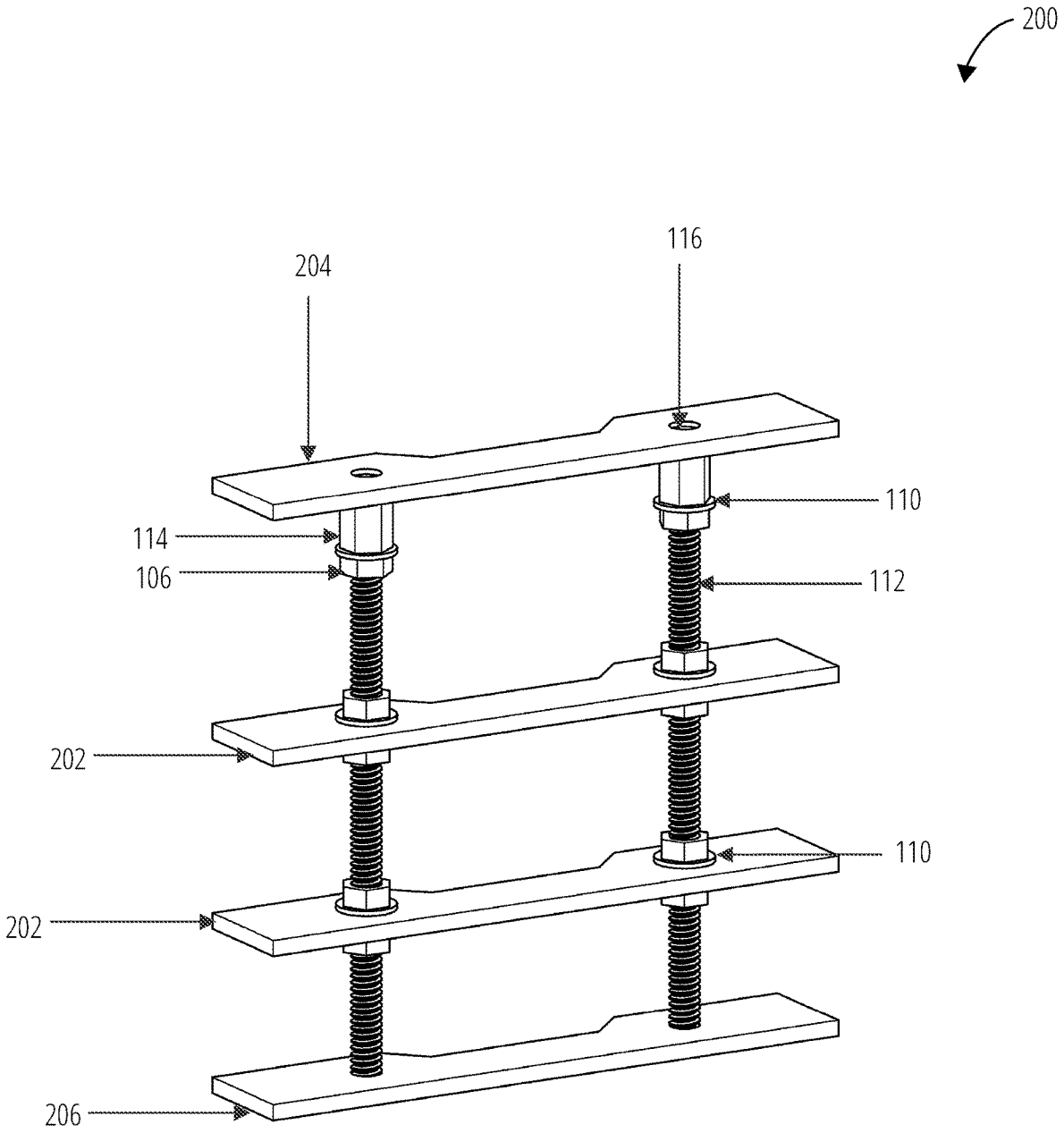
FIG. 2 illustrates a perspective view of an assembled kit 200 in accordance with one embodiment of the invention.

FIG. 2 illustrates an assembled kit in accordance with one embodiment of the invention. This embodiment of the invention is designed to be configured with two drawer units.

It can be seen that, in this embodiment, two threaded rods 112 are inserted through the holes 116 in two central support plates 202 and are secured in place at the desired height by a combination of washers 110, split rings 108 and nuts 106.

Lower support plate 206 is positioned beneath the central support plates 202 with the countersunk holes 104 in the lower support plate 206 cooperatively engaged with lower ends of the threaded rods 112.

An upper support plate 204 is positioned above the central support plates 202 with the countersunk holes 104 in the upper support plate 204 cooperatively engaged with upper ends of the threaded rods 112.

Individual spacers 114 are positioned in such a way that they cooperatively engage with either the upper support plate 204 (as in the embodiment illustrated in FIG. 2) or the lower support plate 206 and, when torqued to produce a pressure fit mounting between the upper and lower support plates and inner surfaces of cavity, box or alcove.

The upper support plate 204 and lower support plate 206 functioning to dissipate the pressure when the spacers 114 are torqued to provide the pressure fit mounting, thereby not damaging the interior surfaces of the cavity, box or alcove.

Figure 3:
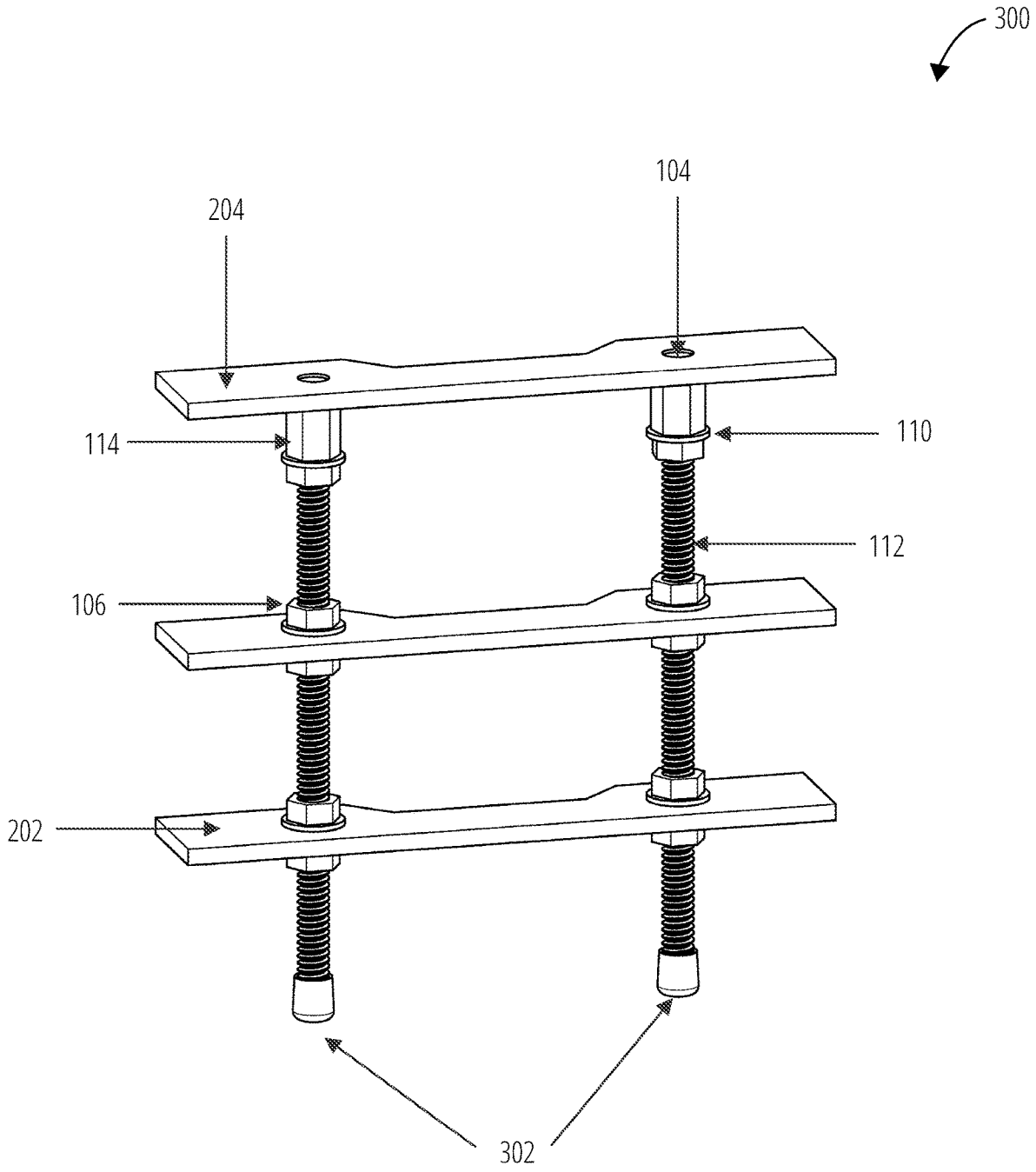
FIG. 3 illustrates a perspective view of an assembled kit 300 in accordance with another embodiment of the invention.

FIG. 3 illustrates a similar assembled kit accordance with one embodiment of the invention. This embodiment of the invention closely resembles that shown in FIG. 2 in that it is designed to be configured with two drawer units.

The embodiment of the invention shown demonstrates the use of rubber caps 302 on lower ends of the threaded rods 112 in place of the lower support plate 206 illustrated in FIG. 2. The function of the rubber caps 302 is again to dissipate the pressure when the spacers 114 are torqued to provide the pressure fit mounting.

Figure 4:
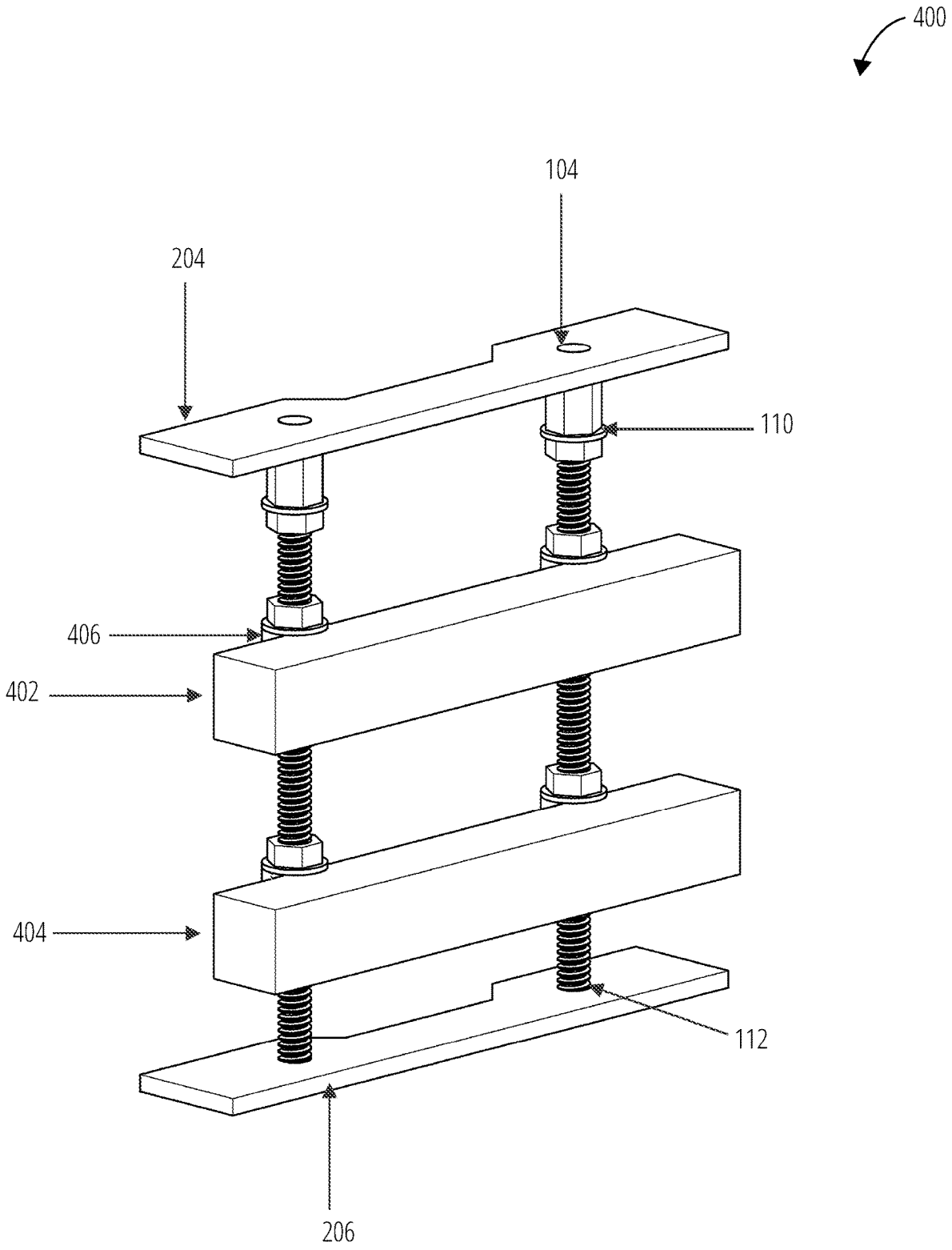
FIG. 4 illustrates a perspective view of an assembled kit 400 in accordance with a further embodiment of the invention.

FIG. 4 illustrates a similar assembled kit accordance with one embodiment of the invention. This embodiment of the invention closely resembles that shown in FIG. 2 in that it is designed to be configured with two drawer or shelf units.

The drawer or shelf units, in this embodiment, comprise a first solid support member 402 and a second solid support member 404. The solid support members do not have holes 116 that cooperate with the threaded rods 112 as in FIG. 2 and FIG. 3, the members are secured in place by the attachment of brackets 406 or the like.

The height of the first solid support member 402 and second solid support member 404 are adjusted and secured in place by an appropriate combination or washers 110, split rings 108 and nuts 106. Again the pressure fit mounting kit is fitted into position by torqueing the spacers 114.

Figure 5:
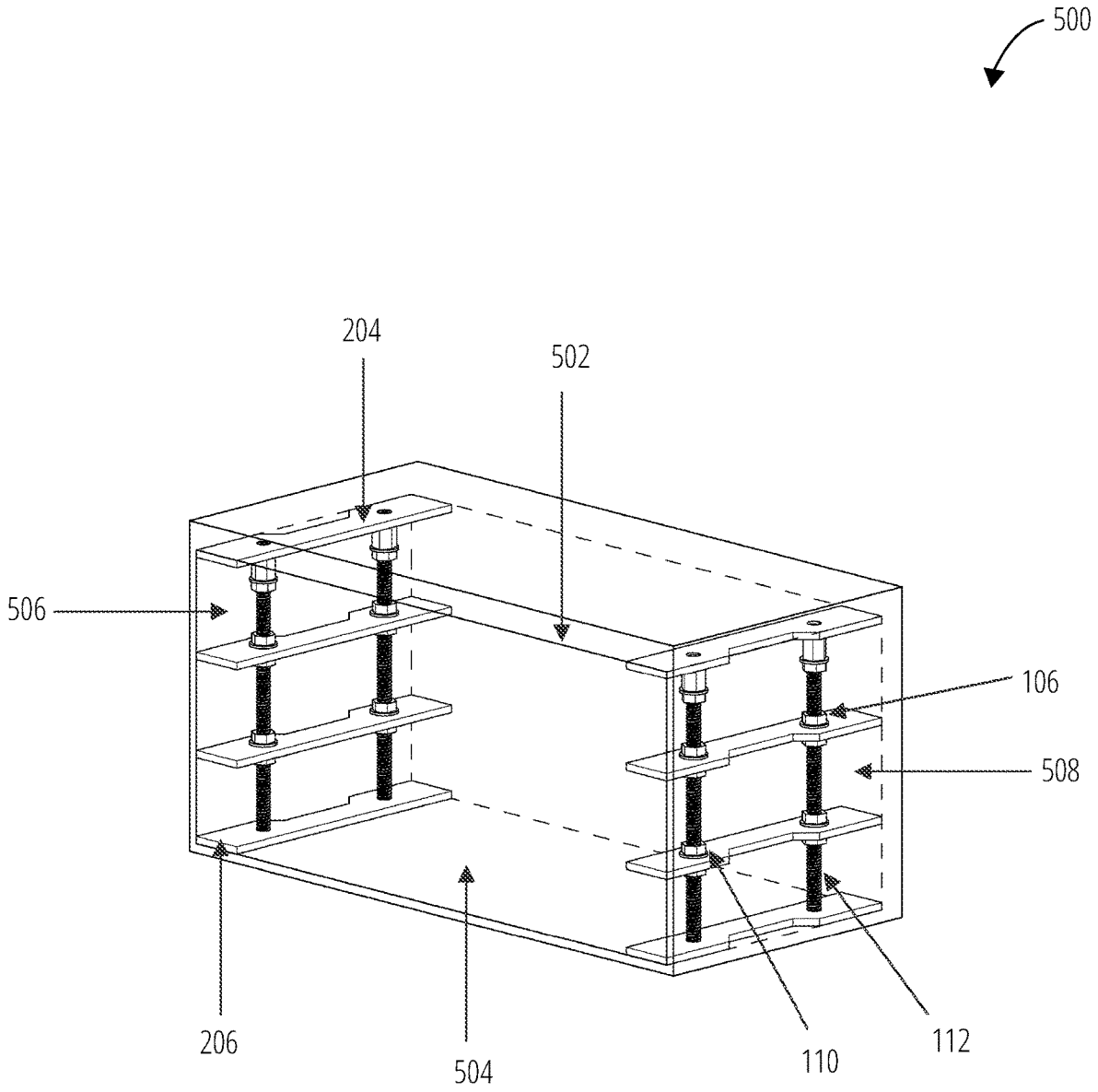
FIG. 5 illustrates a perspective view of an assembled kit 500 in accordance with an additional embodiment of the invention, when mounted within a cavity or cargo box.

FIG. 5 illustrates an assembled kit accordance with one embodiment of the invention when installed inside a cavity or cargo box.

The preassembled pressure fit mounting kit is slid into the cavity or cargo box such that the upper support plates 204 are in approximate contact with the upper surface of cavity or cargo box 502 and the lower support plates 206 are in approximate contact with the lower surface of cavity, cargo box or alcove 504. The nuts 106 and spacers 114 are then adjusted to secure the pair of pressure fit mounting kits in place within the cavity, cargo box or alcove such that one of the assembled mountings is located to the right side of cavity or cargo box 508 and the other of the assembled mountings is located to the left side of cavity or cargo box 506.

Extendible runner mechanisms, known in the field, may be attached to the central support plates 202 and corresponding sliders are then attached to premade drawers or shelves or racks. The weight of the items placed in the drawers or on the shelves or racks is dissipated by the lower support plates 206 or the rubber caps 302 (not shown in this embodiment but described elsewhere).

Figure 6:
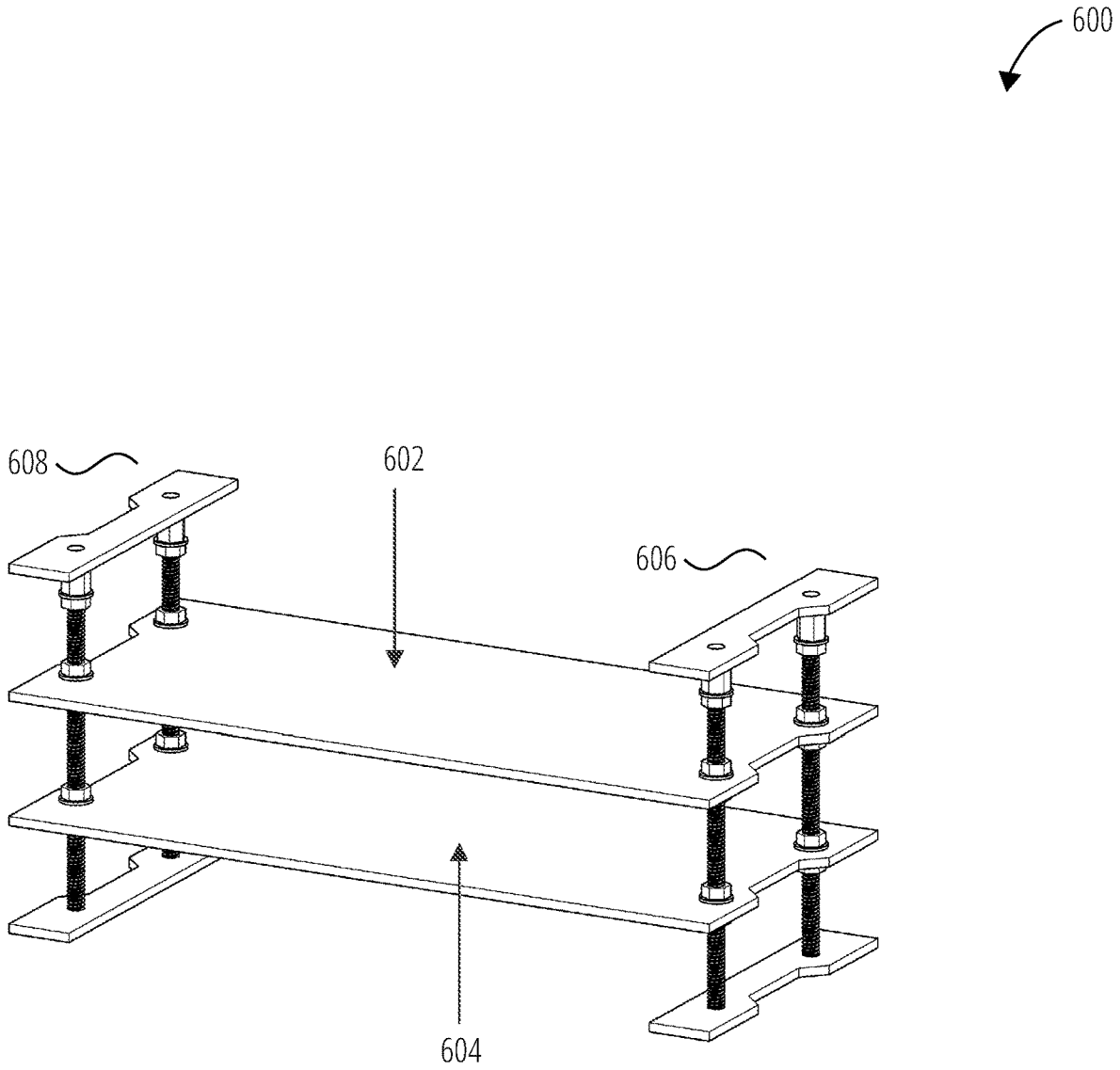
FIG. 6 illustrates a perspective view of an assembled kit 600 in accordance with an additional embodiment of the invention, when adapted to support shelves.

FIG. 6 illustrates an assembled kit accordance with one embodiment of the invention wherein the kit is used to support shelves. This embodiment resembles that illustrated in FIG. 5, with shelves replacing the drawers.

The pressure fit mounting kit is assembled and slid into a cavity or cargo box such that the first assembled side mount kit 606 and the second assembled side mount kit 608 are approximately located at the sides of cavity or cargo box.

In this embodiment each pair of central support plates (indicated in FIG. 2 as 202) are of a unitary structure, essentially a shelf. In the embodiment illustrated in FIG. 6, two shelves are shown; an upper shelf 602 and a lower shelf 604. The nuts 106 and spacers 114 are then adjusted to level the shelves and secure the pair of pressure fit mounting kits in place within the cavity or cargo box.

Figure 7:
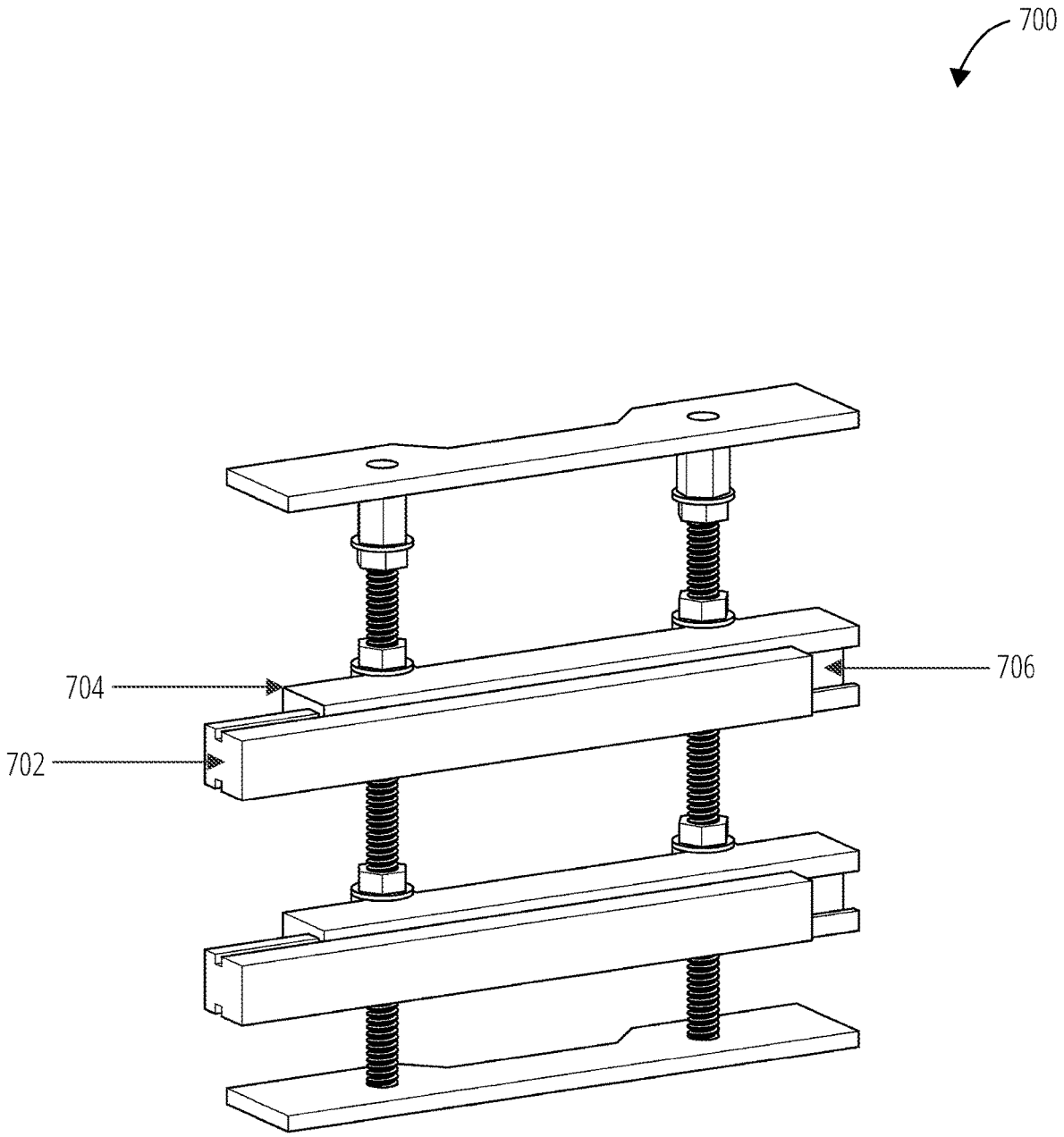
FIG. 7 illustrates an illustrates a perspective view of an assembled kit 700 in accordance with an additional embodiment of the invention, when adapted to receive a drawer.

FIG. 7 illustrates part of an assembled kit accordance with one embodiment of the invention wherein the kit cooperates with a drawer slider member 702.

The pressure fit mounting kit is assembled and slid into a cavity, cargo box or alcove such that the first assembled side mount kit 700 is approximately located at the one side of a cavity, cargo box or alcove. A second assembled side mount kit, not shown, is approximately located at the other side of a cavity, cargo box or alcove.

A drawer slider member 702 attached to a drawer, not shown, is sized and positioned to cooperated with a corresponding drawer slider mechanism 706 on the adapted first solid support member 704.

It is contemplated that the drawer slider member 702 and drawer slider mechanism 706 can be configured as shown in FIG. 7, or can be any of the type of slider members and slider mechanisms known in the field. They are typically made of metal or alloys of metal such as aluminum, steel or stainless steel. They are typically of the telescopic sliding style having wheels or bearings to achieve the necessary sliding function.

The drawer slider mechanism 706 may be formed into the first solid support member 402 (as shown in FIG. 4), or it may be a separate mechanism that is attached to the central support plates 202 (as shown in FIG. 2) or attached to the first solid support member 402 (as shown in FIG. 4).

In an alternative embodiment, the drawer slider mechanism 706 can be affixed to the top or side of the central support plates 202 of first solid support member 402.

Typically the drawer slider mechanism 706 is screwed into place on the central support plates 202 or the first solid support member 402. The drawer slider member 702 may be screwed into the drawer, or it may be a unitary part of the draw.

In this embodiment each pair of central support plates (indicated in FIG. 2 as 202) or the first solid support members (indicated in FIG. 4 as 402) have a drawer slider mechanism 706 either affixed or as an integral part on central support plates 202 or upper support plate 204. The nuts 106 and spacers 114 (as shown in FIG. 1) are then adjusted to level the opposing support plates and secure each of the pair of pressure fit mounting kits in place within the cavity or cargo box. A standard drawer unit, comprising externally facing drawer slider member 702 can then be installed in a cooperatively associated manner with each of the drawer slider mechanism 706.

The fastening components of the kit, as shown in FIG. 1, i.e. the nuts 106, washers 110, split rings 108 and threaded rods 112, are typically fabricated from steel. The lower, central and upper support plates can be made from various materials including but not limited to as wood, metal and plastic. The metal may be selected from steel, galvanized steel, stainless steel, aluminum, or cadmium, chromium, copper, iron, lead, nickel, tin, zinc, or any combination thereof. The plastic can be any high density plastic or thermoplastic such as high density polyethylene (HDPE), polyethylene terephthalate glycol (PETG) and the like.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiments described were chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A pressure fit mounting kit, comprising:

two or more pairs of threaded rods;

one of more pairs of drawer slider members and drawer slider mechanisms;

one or more pairs of support plates connected to the threaded rods, and said support plates further connected to said drawer slider mechanisms;

securing structures attached to the threaded rods and configured to secure the threaded rods in place within a cavity, said securing structures being selected from: non-slip rubber caps or feet; or additional support plates, said securing structures attached to upper and lower ends of the threaded rods;

wherein each said threaded rod includes a series of washers, spacers, and split rings attached at the upper or lower end thereof, the plurality of series of washers, spacers, and split rings configured to adjust the securing structures at the upper or lower ends of the threaded rods, for creating a pressure fit between each said securing structure and the cavity, to thereby secure the threaded rods in place; and fastening structures for fastening the support plates on the threaded rods, wherein, the support plates are secured horizontally in place on the threaded rods by the fastening structures.

2. The pressure fit mounting kit of claim 1, wherein the drawer slider members cooperate with the drawer slider mechanisms attached to opposing sides of a drawer.

3. The pressure fit mounting kit of claim 1, comprising two or more said pairs of support plates connected to two or more said pairs of drawer slider members and drawer slider mechanisms and two or more drawers.

4. The pressure fit mounting kit of claim 1, wherein the securing structures are extendible by adjusting the spacers.

5. The pressure fit mounting kit of claim 1, wherein the support plates are connected to the threaded rods by way of holes in the support plates configured in size and position to receive the threaded rods.

6. The pressure fit mounting kit of claim 5, wherein the means of fastening structures comprise a series of washers, spacers and split rings.

7. The pressure fit mounting kit of claim 1, wherein the support plates are connected to the threaded rods by way of brackets configured in size and position to receive the threaded rods.

8. The pressure fit mounting kit of claim 1, wherein the support plates are fabricated from a high density plastic or thermoplastic.

9. The pressure fit mounting kit of claim 8, wherein the high density plastic is high density polyethylene.

10. A method of installing one or more drawers in a cavity, said cavity having a roof, a floor and two opposing side walls, said method comprising the steps of:

constructing a pair of side mounting mechanisms, each said side mounting mechanism comprising:

two or more threaded rods; and one or more horizontal support plates configured to cooperate with drawer slider mechanisms, said support plates being attached to said two or more threaded rods;

attaching securing structures to the threaded rods in order to secure the threaded rods in place within the cavity, said securing structures being selected from: non-slip rubber caps or feet; or additional support plates, said securing structures attached to upper and lower ends of the threaded rods;

fastening one of the pair of side mounting mechanisms adjacent to each of the two opposing side walls of the cavity, by extending the securing structures using a series of washers, spacers and split rings, until a secure pressure fit is achieved between the securing structures and the roof of the cavity, and between the securing structures and the floor of the cavity;

attaching one said drawer slider mechanism to an inner surface of each of the horizontal support plates; and installing a drawer, comprising a drawer slider member sized and positioned on outer side edges of the drawer to cooperate with the drawer slider mechanisms on the horizontal support plates, said drawer sized to fit within the cavity.

11. The method of claim 10, further comprising:

installing an additional drawer, said additional drawer comprising a slider mechanism sized and positioned on outer side edges of the additional drawer to cooperate with a different two of the horizontal support plates, said additional drawer sized to fit within the cavity.

* * * * *